United States Patent [19]

Wehr et al.

[11] 4,444,097

[45] Apr. 24, 1984

[54] DEVICE FOR APPLYING AND TENSIONING A STRAPPING BAND AROUND A PACKAGE

[75] Inventors: Hubert Wehr, Bornheim; Karl-Heinz Schlosser, Bruhl; Rolf-Gunther Fritze, Cologne, all of Fed. Rep. of Germany

[73] Assignee: Cyklop International Emil Hoffmann KG, Fed. Rep. of Germany

[21] Appl. No.: 376,580

[22] Filed: May 10, 1982

[30] Foreign Application Priority Data

May 12, 1981 [DE] Fed. Rep. of Germany ..... 3118712

[51] Int. Cl.[3] ..... B65B 13/22

[52] U.S. Cl. ..... 100/4; 100/32

[58] Field of Search ..... 100/4, 29, 32, 26, 33 PB

[56] References Cited

U.S. PATENT DOCUMENTS

| | | | |
|---|---|---|---|
| 3,023,693 | 3/1962 | Crosby | 100/32 |
| 3,272,113 | 9/1966 | Otto | 100/32 X |
| 3,327,618 | 6/1967 | Cook | 100/32 X |
| 4,212,238 | 7/1980 | Simmons | 100/32 |

*Primary Examiner*—Billy J. Wilhite

*Attorney, Agent, or Firm*—Robert S. Lipton

[57] ABSTRACT

A device, for feed and tensioning a strapping band about a package in a strapping machine, is disclosed. The machine includes a feed roller which is actuately deflected when the band is placed under tension by a tensioning device. The tensioning device includes a pair of counter rotating v-belts between which the band passes and a pressure device which causes the band to be gripped by the v-belts thus placing it in tension. As the tension on the band increases the pressure exerted by the pressure device is proportionately increased by an angular lever to which the feed roller is connected, which in turn acts on a slidable rod which, through a toggle lever, actuates the pressure device. The machine also includes a sealing and cutting device which is actuated subsequent to the tensioning of the band and which, through a rocker lever, causes the toggle lever to release the pressure on the pressure device prior to the cutting of the rear end of the band.

10 Claims, 2 Drawing Figures

DEVICE FOR APPLYING AND TENSIONING A STRAPPING BAND AROUND A PACKAGE

BACKGROUND OF THE INVENTION

This machine relates generally to strapping machines which apply tension, and a secure strapping band about one or more packages. In particular, the invention relates to a device for applying and tensioning a band in such machines. The device includes a pair of counter rotating belts between which a band passes, which engage or nip the band thereby placing it in tension.

Strapping machines with a tensioning and sealing device and an annular channel for feeding the band about the package are well known in the prior art. Such machines apply a steel or plastic band about a package which is then tensioned and sealed, for example, with a sealing jacket. The tensioning device of such prior art machines generally place the band in tension by gripping or nipping it between a pair of pressure members, such as rollers. As the tensile stress constantly becomes greater during tensioning it is not uncommon for slippage to occur between the rollers and the strapping band with the result that the desired band tension is not achieved before the ends of the band are sealed.

SUMMARY OF THE INVENTION

It is an object of the present invention to provide a tensioning device for packaging machines, including means for providing a pressure proportional to the band tension in order to prevent slippage between the tensioning device and the strapping band so as to be able to continue the tensioning operation as band tension increases. This object is achieved by connecting the pressure members by a series of levers and a rod to the fed roller in such a manner that the pressure exerted by the pressure members on the band increases with increasing band tension. As tension is applied to the band a feed roller is deflected from its normal position. The feed roller in turn moves a lever, upon which it is mounted, which slides a rod. The rod in turn moves another lever which moves one of the pressure members.

The present invention successfully permits control of the contact or compression pressure of the tension device to be dependent on the tension produced in the band. It also permits the constant maintenance of the frictional engagement of the strapping band between the pressure members of the tension device as the band tension increases due to the contact pressure automatically increasing with increase in band tension.

The lever upon which the deflectable feed roller is mounted is an angular lever, or v-shaped member, having the roller mounted on one leg while the other leg acts to move the sliding rod and actuate a switch which disengages the drive for the tension device. The switch is adjustable so that it automatically turns off the tension device as soon as the required band tension has been reached.

In accordance with the present invention, the tension device includes pressure members having two counter-rotating driven endless belts between which the strapping band is positioned and which are pressed together by pressure rollers which are actuated by a toggle lever. With tensioning belts of this type, which may be in the form of v-belts, even smooth strapping bands made of plastic can be highly tensioned without their surface being damaged by the tension device during tensioning.

It is particularly advantageous if the pressure members include several pressure rollers which are mounted in bearing members in two rows arranged on opposite sides of the strapping band in such a manner that the pressure rollers of the one row are staggered over the length of the strapping band and the belts opposite the pressure rollers of the opposite row. One bearing member is connected to the toggle lever so that it may be moved, while the other bearing member is mounted to the strapping machine frame. With this arrangement, the pressure roller of one row are positioned, to a certain degree, in the spaces between the presure rollers of the other row with the result that the belts running between them, which sandwich the strapping band, are forced to pass through the tension device in an undulatory form. Due to the opposite pressure rollers of the tension device being staggered, a contact pressure is produced which is oblique to the direction of motion on the belts and band which passes between them. Thus, the strapping is caused to be gripped by the belts due to the compressive force exerted against the belts by the pressure rollers and is not merely pulled along by longitudinally acting static friction forces.

As previously indicated, the angle lever is connected to the toggle lever by a sliding rod. The rod includes two members which are pivotally connected together at a rod joint. Means are provided which tend to maintain the rod in a straight position. Prior to the cutting of the band, the rod is caused to deflect thereby eliminating the pressure on the rollers and, hence, the tension in the band. This is particularly important as strapping bands made of plastic have the property of fraying and fanning out in the direction of the longitudinal axis of the band if they are severed or cut while under tensile stress.

It is thus possible to abruptly eliminate the tension in the rear end of the band leading to the supply roll in a very simple manner. This is accomplished by making the sliding rod ineffective so that pressure is not exerted by the tensioning device while the band has deflected the feed roller.

The actuating member for laterally deflecting the sliding rod is a lever, one end of which acts upon the rod joint and the other end of which is moved by the sealing and cutting device. This is not done until band clamps in the sealing and cutting device have secured the tensioned band about the package and it is therefore no longer necessary to apply a tensile force on the end of the band.

Other objects and advantages of the invention are shown in the following description and the drawings in which a preferred embodiment of the invention is described in more detail.

BRIEF DESCRIPTION OF THE DRAWINGS

In the drawings, in which like numerals refer to like parts.

DESCRIPTION OF THE PREFERRED EMBODIMENT

Figure 1:
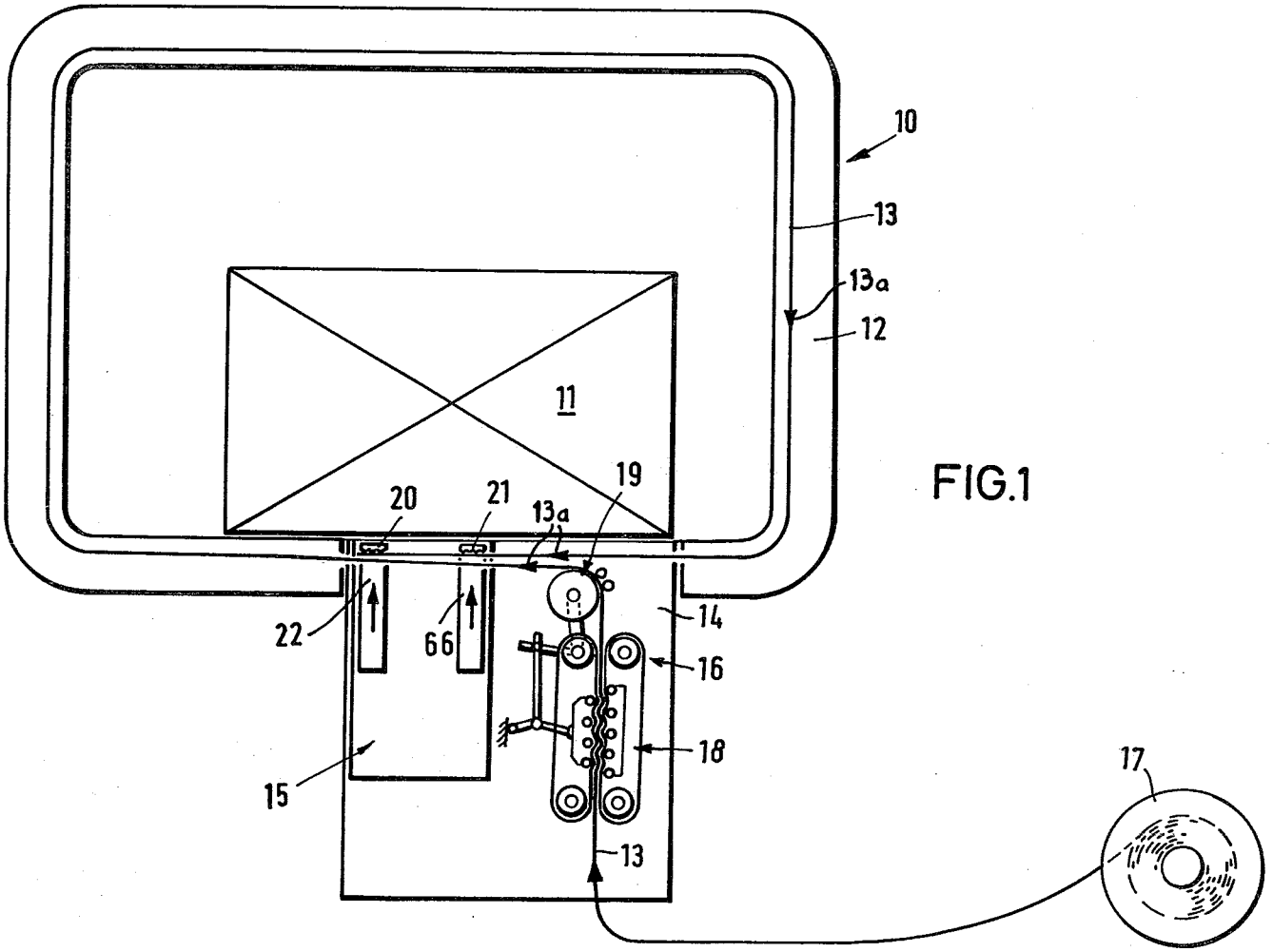
FIG. 1 is a schematic front view of a strapping machine which includes the present invention.

A strapping machine 10 for binding packages 11 is shown in FIG. 1. The machine 10 has an angular band guide channel 12, which surrounds the package 11 to be strapped wherein the strapping band 13 is advanced in the direction of the arrow 13*a* and is applied around the package 11.

Connected to the machine base or frame 14, under the band guide channel 12 is a sealing and cutting device 15 and a band feed and tensioning apparatus 16 which is positioned to feed the strapping band 13 from a feed or supply roll 17. The band feed and tensioning apparatus 16 includes a band tensioning device 18 and a feed mechanism 19. The strapping band 13 coming from the supply roll 17 runs through the band tensioning device 18 and is advanced by the feed mechanism 19 in the direction of the arrow 13*a* through the band guide channel 12 until it runs up against a stop 20 in the sealing and cutting device 15. In the direction of feed in front of this stop there is a band clamp 21 with which the front end of the band is secured or nipped.

The strapping band 13 is then drawn at its rear end in a reverse direction from the band tensioning device, i.e., opposite of the direction of the arrow 13*a*. The band 13 then moves radially inwards from the band guide channel 12, so that it is wrapped around the package and is drawn tight by the band tensioning device 18 and placed in tension around the package 11. As soon as the desired band tension is achieved, the rear end of the band is nipped or secured in a second clamp 22 of the sealing and cutting device 15. The band ends located between the band clamps 21 and 22 are then sealed together with a lead seal or sealing jacket, not shown, by the sealing device 15. The rear end of the band is then cut off.

Figure 2:
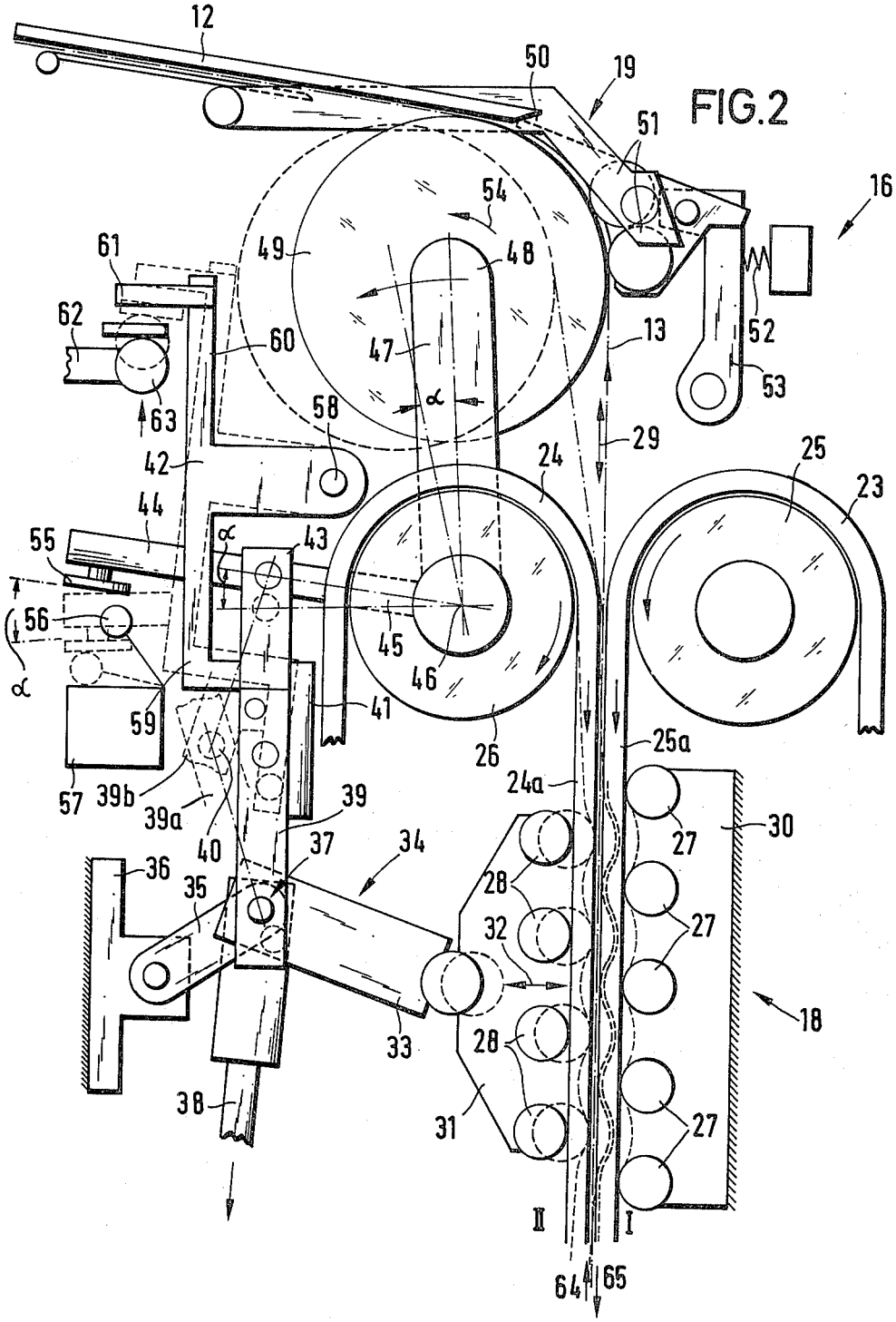
FIG. 2 is an enlarged schematic front view of the feed and tensioning device of the present invention shown in FIG. 1.

The feed and band tensioning apparatus according to the present invention is shown in more detail in FIG. 2. The tensioning device 18 includes a tension means which acts on the strapping band 13. The tensioning device 18 has two counter-movable parts formed by two endless v-belts 23 and 24 which are tensioned about and driven by pulleys arranged at a distance from one another. The upper pulleys 25 and 26 only are shown in FIG. 2. The strapping band 13 is positioned between the opposing inner surfaces 24*a* and 25*a* of the v-belts 23 and 24, which are pressed together by pressure rollers 27 and 28 thereby nipping the strapping band 13 between them.

The pressure rollers 27 are arranged in a row I in longitudinal direction 29 on one side of the v-belts 23 and 24 of the strapping band, and are rotatably connected to a bearing member 30 which is firmly anchored in the machine frame 14. The pressure rollers 28 are similarly arranged in a row II on the other side of belts 23 and 24 in longitudinal direction 29 of the strapping band 13, and are laterally spaced from one another. The rollers 28 are rotatably connected to a bearing member 31, which is movable in a direction which is substantially perpendicular to the longitudinal direction of the strapping band 13 as indicated by arrow 32*a*. The bearing member 31 and its pressure rollers 28 can be moved towards and away from the bearing member 30.

As can be seen in FIG. 2, the pressure rollers 28 are arranged in relation to the pressure rollers 27 in such a way that they are staggered opposite one another, i.e., the rollers 28 are located in longitudinal direction 29 of the strapping band opposite the spaces between the pressure rollers 27.

The movable bearing member 31 is pivotally connected to a leg 33 of a toggle lever 34. The other leg 35 of the toggle lever 34 is pivotally mounted on a fixed abutment 36 connected to the machine frame. The legs 34 and 35 are pivotally connected to a pull rod 38 at a toggle joint 37. The pull rod 38 is placed in tension by a device, not shown. The device may be, for example, a spring or magnet. The tension producing device pulls on the rod 38 tends to extend the toggle lever 34 by moving joint 37. On the opposite side of the toggle joint 37 of the toggle lever 34 is a sliding rod 39 which is also connected to toggle joint 37. The rod 39 consists of two parts 39*a* and 39*b*, which are pivotally connected by the rod joint 40 in such a manner that the rod 39 tends to remain straight.

The joint 40 is abutted by a freely projecting leg 41 of a second lever 42 located on the right side of the push rod 39 shown in FIG. 2, which is more fully described below.

The upper sliding rod section 39*b* is pivotally connected at its upper end 43 to leg 44 of an angular lever 45. The angular lever 45 is pivotally mounted at its apex on the axis 46 of the upper pulley 26 of the v-belt 24. The other leg 47 of the angular lever 45 protrudes upward and has mounted on its free end 48 a feed and deflection roller 49 of the feed mechanism 19, which drives the strapping band and slides it through the band guide channel 12.

The feed roller 49 is positioned below an intake 50 of the band guide channel 12 and interacts with two contact pressure rollers 51, which are located on a rocking lever 53 and which are pressed by a spring 52 against the feed roller 49 so that the strapping band running between the roller 49 and the back-pressure rollers 51 is pressed against the feed roller 49 and is driven along by it when the feed roller 49 rotates in the direction of arrow 54.

As can be seen in FIG. 2, the leg 44 of the angular lever 45 has at its free end a pressure plate 55, which acts upon the operating member 56 of a switch 57. The switch 57 turns the drive of the tensioning device 18, not shown more closely here, on and off, as will be more clearly explained.

The rocker lever 42, previously referred to above, has essentially a z-shaped form and is connected to the machine frame so that it may rotate about an axis 58. Its freely projecting leg 41 which is connected to a lower arm 59 abuts at its free end against the joint 40. The upper arm 60 of lever 42 is provided with a lug 61 upon which an operating finger 62 fitted with a pressure roller 63 acts. The finger 62 is located on a movable part of the sealing and cutting device 15, shown in FIG. 1.

The mode of operation of the invention will now be described.

The strapping band 13 pulled off of the supply roller 17 is first inserted between the v-belts 23 and 24 of the tensioning device 18 and advanced between the feed roller 49 and the back up rollers 51. The tensioning device 18 and the feed device 19 are initially located in the positions shown in solid lines. The v-belts 23 and 24 are, at this point, still slightly apart from one another.

When the drive is switched on the strapping band is first moved in direction of feed 64 and advanced by the feed mechanism 19 through the band guide channel 12 as far as the stop 20. The feed roller 49, which is driven by the rotary drive, not shown, of the tensioning device 18, rotates with the same velocity and in the same direction as the v-belts 23 and 24.

As soon as the strapping band has contacted the stop 20 and is nipped by the clamp 21, the drive of the tensioning device 18 is reversed.

Due to the effect of the tension device pulling on the rod 38, the toggle lever 34 is then somewhat extended whereby the bearing member 31 is moved towards the bearing member 30 and the v-belts are pressed together with the strapping band lying between them.

The v-belts 23 and 24 which grip the strapping band between them now pull the band 13 back in the direction of the arrow 65, so that the band is drawn about the package 11 and is tensioned as previously described. As the tension increases in the strapping band 13, the feed roller 49 together with the angular lever 45, on which it is mounted, are pivoted counterclockwise about the axis 46 in the direction of the arrow at end 48 of leg 47. This causes leg 44 of the angular lever 45 to exert a force on the extended push rod 39 which is transmitted to the toggle joint 37 of the toggle lever 34. The toggle lever 34 is thus caused to move downward thereby increasing the force acting on the movable bearing member 31 and its pressure rollers 28. The pressure rollers 28 are thus pressed with ever increasing force from the left towards the v-belts 23 and 24 and are pressed into the gaps between the pressure rollers 27 of the fixed bearing member 30. The pressure rollers 28, the v-belts 23 and 24 and the strapping band 13 located therebetween then assume the position as shown by the broken lines in FIG. 2. In this position the v-belts 23 and 24 are pulled along with the strapping band 13 in an undulatory fashion between the pressure rollers 27 and 28 of the tensioning device 18.

It can thus be seen that the contact pressure exerted on the strapping band in the tensioning device is proportional to the tension of the strapping band and becomes increasingly larger with the growth in band tension, so that the strapping band cannot slip between the v-belts 23 and 24.

As soon as the desired band tension about the package is reached, the pressure plate 55, which rotates with the angular lever 45 through an angle $\alpha$ actuates the switch 57 which operates the control for the sealing mechanism and causes the drive of the tensioning device 18 to stop. The band clamp 22 is the sealing and cutting device 15 shown in FIG. 1, which can be independently or automatically operated, secures the strapping band surrounding the package 11. After the clamp 22 is engaged, the sealing and cutting mechanism of the device 15 is acutated in order to connect the band ends located between the band clamps 21 and 22 and to cut off the rear end of the strapping band still in the tensioning device 18 and leading to the supply roller 17. However, before the rear end of the band is severed by the cutting blade 66 shown in FIG. 1 the operating finger 62 connected to the sealing and cutting mechanism rotates the rocker lever 42 in a clockwise direction by abutting lug 61. The leg 41 of the rocker lever 42 then abuts the joint 40 thereby forcing the two parts **39*a* and 39*b* of the sliding rod 39, which forms joint 40, to the left, as shown by the broken lines in FIG. 2. In so doing, no more compressive force can be transmitted by the sliding rod 39 from the angular lever 45 to the toggle lever 34, with the result that the toggle joint 37 moves upward and the bearing member 31** moves to the left along the pressure rollers, thus returning them to the position shown in solid lines. The tension at the rear end of the strapping band is thereby eliminated, with the result that the rear end of the strapping band is no longer under tension when it is severed by the blade of the cutting device.

The present invention is not, however, to be restricted to the embodiment shown and described. Various changes and modifications may be made within the scope and spirit of the invention.

What is claimed is:

1. A device for applying and tensioning a strapping band around a package which comprises: a feed mechanism for feeding the band about the package; a tension device, having a pair of pressure members for nipping the band and for tensioning the band about the package; and control means connected to the pressure member of the tension device for causing the pressure exerted by the pressure member to be proportional to the tension in the band thereby preventing the band from slipping with respect to said pressure members.

2. The device of claim 1 wherein the pressure members are a pair of counter movable parts which nip the band and wherein said control means includes a deflection member connected to the device so that its degree of deflection is proportional to the tension in the band when the tension device is operative, said deflection member being connected to the pressure members.

3. The device of claim 2 wherein said control device further includes: a toggle lever adapted to move the pressure members together, a slidable rod connected at one end thereof to said toggle lever, and a lever connected to the other end of said rod and the said deflection member.

4. The device of claim 3 wherein said deflection member is a roller and wherein said lever is an angular lever having a first leg which has said deflection roller mounted on the end thereof and a second leg which is connected to said rod and which actuates a switch for turning off the drive for the tension device.

5. The device of claim 3 or 4 wherein the tension device includes two counter-rotating drive-operated endless belts, which sandwich the strapping band therebetween and which are adapted to be pressed together by the pressure members which are activated by said toggle lever.

6. The device of claim 5 wherein each of the pressure members include several pressure rollers rotatably mounted to two bearing members, said rollers of each member being arranged in rows on opposite sides of the strapping band in such a way that the pressure rollers of the one row are staggered with respect to the pressure rollers of the opposite row, and wherein one of the bearing members is fixed and the other bearing member is connected to said toggle lever.

7. The device of claim 6 wherein said rod includes a pair of members pivotally connected at a joint, said rod being straight during tensioning of the band and collapsible when an acutating member of the sealing and cutting device causes said pair of members to pivot at said joint thereby permitting the tension in the band to be removed prior to cutting off the end of the band.

8. The device of claim 7 which further includes a rocker lever wherein one end thereof is moved by the actuating member of the cutting and sealing device and wherein the other end abuts said rod joint thereby permitting the cutting and sealing device to remove the tension in the band.

9. The device of claim 4 wherein said deflection roller is also a feed roller of the feed mechanism.

10. The device of claim 8, wherein said deflection roller is also a feed roller of the feed mechanism.

* * * * *